US005584550A

United States Patent [19]

Kueng

[11] Patent Number: 5,584,550

[45] Date of Patent: Dec. 17, 1996

[54] LEDGELESS PULL-OUT GUIDE FOR SUPPORTING A MOVEABLE STRUCTURE SUCH AS A DRAWER

[75] Inventor: Wernfried Kueng, Kernersville, N.C.

[73] Assignee: Grass America, Inc., Kernersville, N.C.

[21] Appl. No.: 371,132

[22] Filed: Jan. 11, 1995

[51] Int. Cl.[6] ..... A47B 88/00

[52] U.S. Cl. ..... 312/334.6; 312/334.14; 312/334.15

[58] Field of Search ..... 312/334.14, 334.15, 312/330.1, 334.6, 334.7, 334.12, 348.1, 334.1, 334.8, 334.21; 384/19

[56] References Cited

U.S. PATENT DOCUMENTS

| | | | |
|---|---|---|---|
| 4,351,575 | 9/1982 | Rock et al. | 312/334.12 X |
| 4,552,415 | 11/1985 | Fulterer | 312/330.1 X |
| 4,579,402 | 4/1986 | Wenzlick et al. | 312/330.1 |
| 4,919,548 | 4/1990 | Lautenschlager | 384/19 |
| 5,090,786 | 2/1992 | Albiez et al. | 312/330.1 |

FOREIGN PATENT DOCUMENTS

| | | | |
|---|---|---|---|
| 2155731 | 5/1973 | Germany | 312/334.8 |

*Primary Examiner*—Peter M. Cuomo
*Assistant Examiner*—Janet M. Wilkens
*Attorney, Agent, or Firm*—Petree Stockton, LLP

[57] ABSTRACT

A ledgeless pull-out guide for supporting a moveable structure such as a drawer in a furniture article for use with a guide rail includes a pull-out rail movably supportable by a guide rail, the pull-out rail having a web portion and one or more support members extending from the web portion for receiving a drawer.

8 Claims, 2 Drawing Sheets

LEDGELESS PULL-OUT GUIDE FOR SUPPORTING A MOVEABLE STRUCTURE SUCH AS A DRAWER

BACKGROUND OF THE INVENTION

1. Field of the Invention

The present invention relates to a pull-out guide for a drawer or the like and more particularly to a new and improved pull-out guide for supporting a moveable structure such as a drawer in a furniture article for use with a guide rail, the pull-out guide including a pull-out rail movably supportable by the guide rail in a generally horizontally disposed position of the pull-out rail, and the pull-out rail having support members instead of a conventional ledge for receiving and supporting the drawer.

2. Description of the Prior Art

Various types of pull-out guides for drawers have been used with in furniture such as cabinets, desks and the like for supporting drawers and similar moveable structures for many years. One such type of pull-out guide disclosed, for example, in U.S. Pat. No. 4,564,248, is movably supportable by a guide rail which is mountable to the furniture article, and both the guide rail and pull-out guide carrying the moveable structure are provided with rollers. The pull-out guide may carry a structure such as a drawer, a bin, a board or the like, and the respective rollers enable the pull-out guide and carried structure to be moved freely between a forward, open position and a rearward, closed position.

Such pull-out guides include a pull-out rail having a web portion with an upper edge and a lower edge, and the lower edge is provided with a ledge extending perpendicular to the web portion to receive the drawer or similar moveable structure. The ledge serves to properly position the pull-out guide along the bottom edge of the drawer and to support the drawer, and the ledge is also provided with holes for receiving fasteners such as screws, rivets, nails, tacks and the like to fasten the pullout guide to a bottom surface of the drawer.

Typically, such pull-out guides are made by first stamping out a blank of a predetermined size and shape from a continuous web of sheet metal such as steel, then using a stamp or die or the like to bend a lateral edge of the blank to define a drawer supporting ledge along the lower edge of the web portion of the pull-out rail, and mounting a pull-out rail roller on the web portion of the pull-out rail. The cost of the steel used for each pull-out rail is a substantial element of the cost of manufacture, and it is readily apparent that eliminating the supporting ledge would substantially reduce the cost of making each pull-out guide. In practice, it has been determined that the manufacturing cost savings associated with elimination of the supporting ledge would be on the order of at least about twenty-five percent (25%).

It is possible to eliminate the ledge and provide holes in the web portion of the pull-out rail for receiving fasteners such as screws to fasten the pull-out guide to a side surface of the drawer instead of to a bottom surface of the drawer. However, such an arrangement does not afford a way of properly positioning the pull-out guide along the bottom edge of the drawer. Moreover, in such an arrangement, the heads of the fasteners protrude above the surface of the web portion of the pull-out rail and may interfere with movement of the pull-out guide relative to the guide rail because there is typically little, if any, clearance between the guide rail roller and the pull-out rail web portion.

There is a current need to provide a pull-out guide without a drawer supporting ledge, with associated reduction in manufacturing cost, while at the same time retaining the features for properly positioning the pull-out guide along a bottom edge of the drawer and fastening the pull-out guide to a bottom surface of the drawer.

The present invention addresses this need and provides a ledgeless pull-out guide which is designed to enable proper positioning of the pull-out guide along a bottom edge of the drawer and fastening the pull-out guide to a bottom surface of the drawer.

SUMMARY OF THE INVENTION

The general purpose of the present invention, which will be described in greater detail, is to provide a new and improved pull-out guide for drawers for use in a furniture article which has all of the advantages and none of the disadvantages of the prior art.

To attain this purpose, representative embodiments of the present invention are illustrated in the drawings. The pull-out guide of the present invention makes use of an elongate pull-out rail supportable by a guide rail in a generally horizontally disposed position of the pull-out rail, the pull-out rail having at least two support members for properly positioning the pull-out guide along a bottom edge of a drawer, for supporting the drawer, and for fastening the pull-out guide to a bottom surface of the drawer.

The pull-out rail includes a web portion, and each of the support members extends from the web portion. The support members each have portions defining an opening for receiving a drawer fastener such as a screw, a rivet, a nail, a tack or the like through the opening and into a bottom surface of the drawer. Each of the support members may have a generally arcuate shape or a generally triangular shape or such other shape as may be convenient. The support members may be formed by punching or stamping material out of the web portion and stretching the punched or stamped out material to define respective support members, or a lip may be formed on the lower edge of the web portion and the support members may be formed of material stamped and stretched out of the lip to define respective support members.

Preferably, the pull-out rail may also be provided with a flange extending from the upper edge of the pull-out rail web portion for engaging a guide rail roller rotatably mounted on the guide rail. Likewise, the pull-out rail may be provided with a pull-out rail roller rotatably mounted on the pull-out rail web portion for engaging the guide rail. The guide rail is mounted to a furniture article in a generally horizontally disposed position, and the pull-out guide is movably supportable on the guide rail by rolling contact between the pull-out rail upper edge flange and the guide rail roller and rolling contact between the guide rail and the pull-out rail roller.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and carried out in various ways.

It to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that on object of the present invention is to provide a new and improved pull-out guide for a receiving and supporting a moveable structure such as a drawer in a furniture article for use with a drawer guide which has all, and more, of the advantages of prior art pull-out guides and none of the disadvantages.

It is another object of the present invention to provide a new and improved design for a pull-out guide for a drawer that is more reliable and functional and economical to make than those presently available.

Yet another object of the present invention is to provide a pull-out guide for a drawer which eliminates the need for providing a lower positioning and fastening ledge, while retaining the feature of fastening the pull-out guide to a bottom surface of the drawer.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
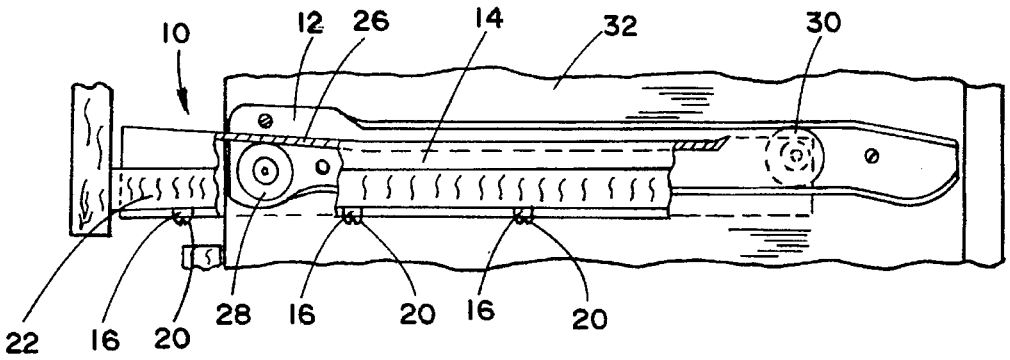
FIG. 1 is a side elevational view of the pull-out guide of the present invention carrying a drawer and supported on a guide rail with portions of the pull-out guide removed to show the guide rail.

Referring now to the drawings, and specifically to FIG. 1, the ledgeless pull-out guide of the present invention includes an elongate pull-out rail shown generally as 10 supportable by a guide rail 12 in a generally horizontally disposed position of pull-out rail 10. Pull-out rail 10 includes a web portion 14, and in lieu of a support ledge, support members 16 extend from web portion 14 as shown in FIGS. 3 and 4.

Figure 3:
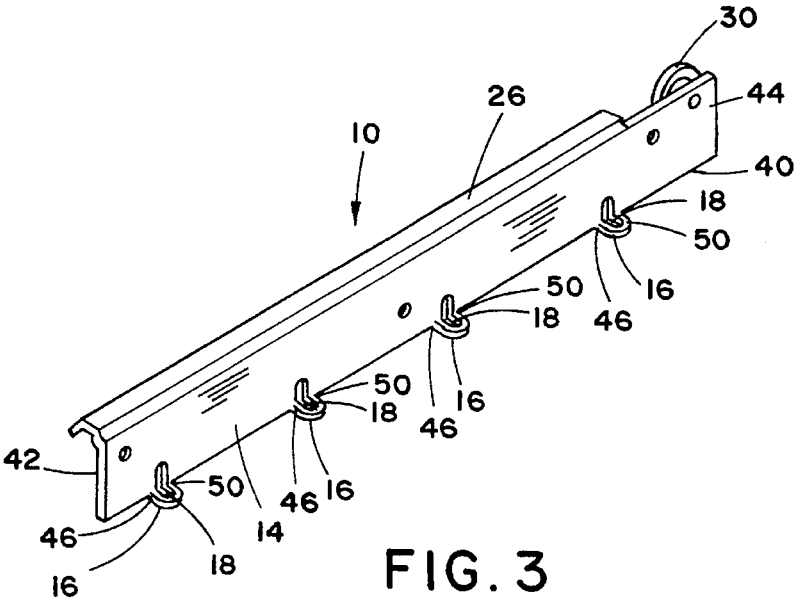
FIG. 3 is a perspective view of the pull-out guide shown in FIG. 1.
Figure 4:
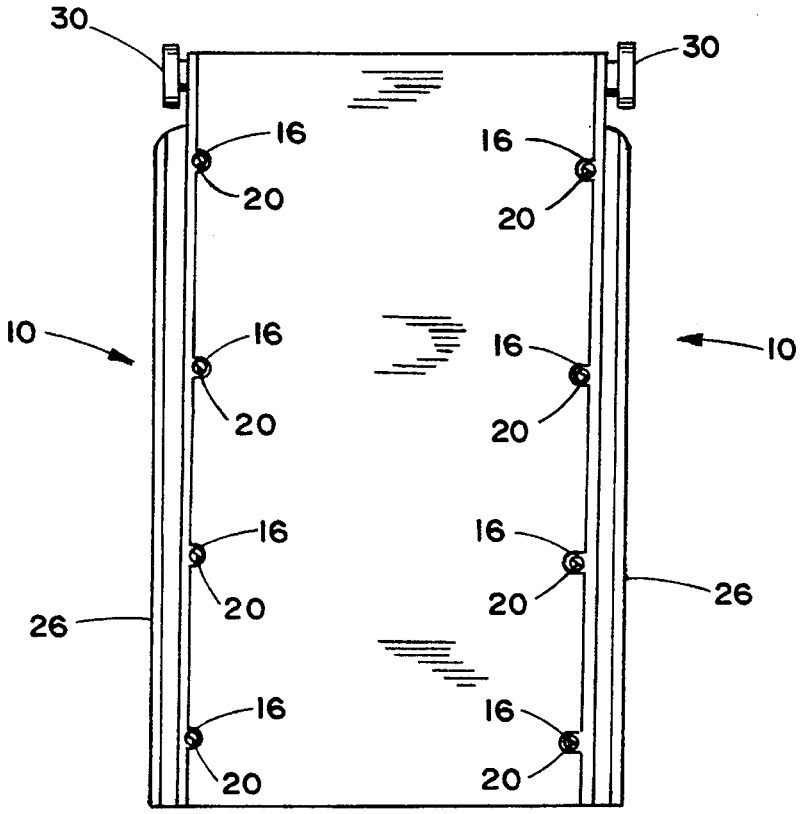
FIG. 4 is a bottom view of the pull-out guide shown in FIG. 1 fastened on opposite sides of the bottom surface of a drawer.
Figure 5:
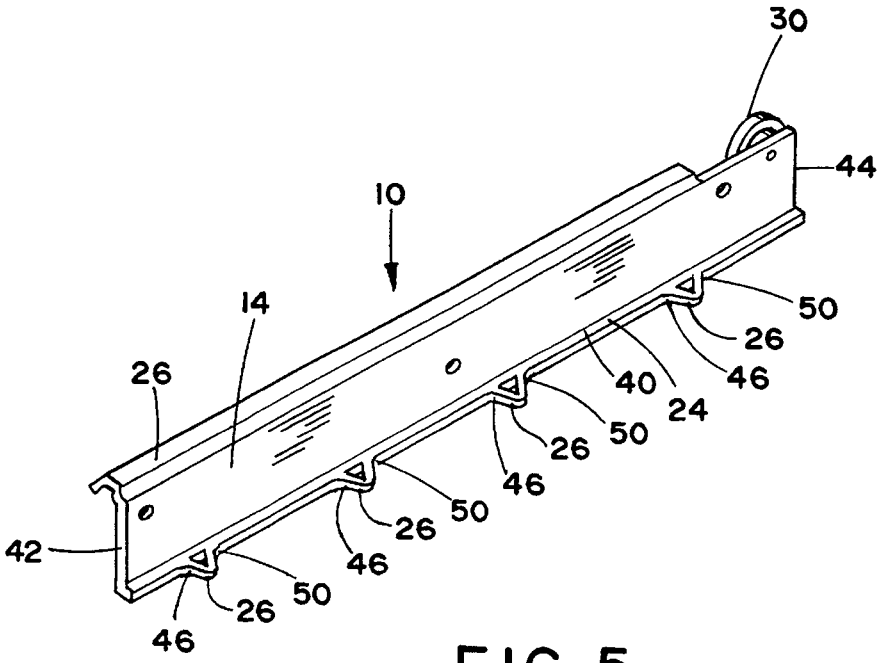
FIG. 5 is a perspective view of an alternate embodiment of the pull-out guide of the present invention.

Each of support members 16 is provided with a fastener opening 18, as shown in FIG. 3, for receiving a drawer fastener such as screw 20 through fastener opening 18 into a bottom surface of drawer 22 as shown in FIG. 4. Preferably, at least two support members 16 are provided on pull-out rail web portion 14, but web portion 14 may likewise be provided with either a single support member 16 or more than two support members 16. Support members 16 may have any convenient shape, for example, a generally arcuate shape as shown in FIG. 3. Support members 16 may be formed out of material punched or stamped and stretched out of web portion 14 as shown in FIG. 3, or alternatively, a lip 24 may be formed on the lower edge of web portion 14 and support members 26 may be stamped and stretched out of lip 24 as shown in FIG. 5. As long as support members 16 are positioned relative to each other to properly position the drawer guide on the drawer, the particular location of support members 16 on web portion 14 is not critical, and it will be appreciated that support members 16 may extend from any position between the upper and lower edges of web portion 14. Support members 26 may likewise have any convenient shape, for example, a generally triangular shape as shown in FIG. 5.

In a preferred embodiment, as shown in FIGS. 3 and 5, support members 16, 26 are punched or stamped out of lower marginal edge 40 of web portion 14 and stretched into ring-like structures. Web portion 14 has a forward end 42 and a rearward end 44, and each support member 16 has a forward edge 46 disposed toward forward end 42 of web portion 14 and extending from lower marginal edge 40 of web portion 14 and a rearward edge portion 50 disposed toward rearward end 44 of web portion 14 and extending from lower marginal edge 40 of web portion 14. Rearward edge 50 of each support member 16 is spaced from forward edge 46 by a distance which determines a width of respective support members 16, and support members 16 are spaced from one another by a distance which is greater than the width of respective support members 16. Each support member 16 is provided with a drawer fastener opening 18 for receiving a fastener 20 through the opening and into the bottom surface of drawer 22.

Figure 2:
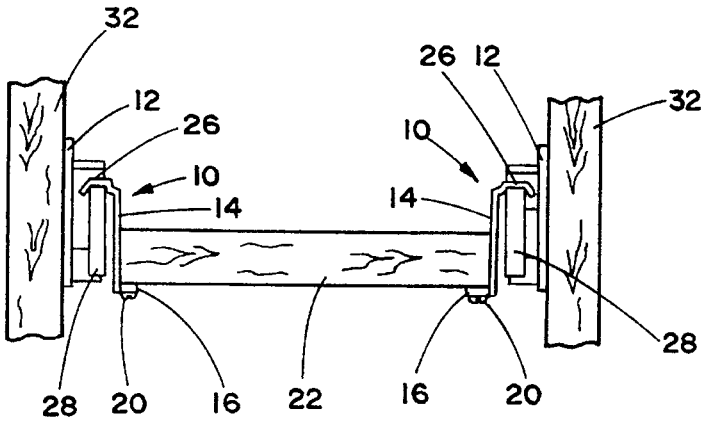
FIG. 2 is a front elevational view of a drawer carried by the pull-out guide shown in FIG. 1.

Preferably, pull-out rail 10 is provided with a flange 27 extending from the upper edge of pull-out rail web portion 14 for engaging a guide rail roller 28 rotatably mounted on guide rail 12 as shown in FIGS. 1 and 2. Likewise, pull-out rail 10 is provided with a pull-out rail roller 30 rotatably mounted on pull-out rail web portion 14 for engaging guide rail 12.

Support members 16 serve as a guide for properly positioning pull-out rail 10 along the bottom edge of drawer 22, and pull-out rail 10 is attached to drawer 22 by means of fasteners such as screws 20 inserted through fastener openings 18 and into a bottom surface of drawer 22. Support members 16 also serve as a support for drawer 22. Guide rail 12 is attached to a furniture article sidewall 32 in a generally horizontally disposed position of guide rail 12 as shown in FIG. 1, and pull-out rail 10 is movably supportable on guide rail 12 by rolling contact between pull-out rail upper edge flange 27 and rolling contact between guide rail 12 and pull-out rail roller 30.

Obviously, any number of materials may be used to form the guide rail and its components described herein, and exceptional success has been experienced by the use of metal such as steel for the pull-out rail, rigid or semi-rigid material such as plastic for the pull-out rail roller, and rigid, semi-rigid or resilient material for the rolling surface of the pull-out rail roller, although other materials may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A pull-out guide for supporting a drawer in a furniture article for use with a guide rail comprising:

an elongate pull-out rail moveably supportable by said guide rail in a generally horizontally disposed position of the pull-out rail, the pull-out rail having a plurality of support members for receiving said drawer, each support member having portions defining a drawer fastener opening for receiving a fastener through the opening and into the drawer, said pull-out rail having a web portion with upper and lower marginal edges, and each support member being stamped out of the lower marginal edge of the web portion and stretched into a ring-like shape and extending from the lower marginal edge of said web portion, said web portion having a forward end and a rearward end, each support member having a forward edge disposed toward the forward end of the web portion and a rearward edge disposed toward the rearward end of the web portion, the rearward edge of each support member being spaced from the forward edge of the support member by a distance which determines a width of respective support members, and the support members being spaced from one another by a distance which is greater than the width of respective support members.

2. The pull-out guide as claimed in claim 1, further comprising a flange extending from said web portion upper marginal edge for engaging said guide rail.

3. The pull-out guide as claimed in claim 2, further comprising a pull-out rail roller rotatably mounted on said web portion for engaging said guide rail.

4. The pull-out guide as claimed in claim 3, said support members each having a generally arcuate shape.

5. The pull-out guide as claimed in claim 1, further comprising a lip formed on the web portion lower marginal edge, and said support members extending from the lip.

6. The pull-out guide as claimed in claim 5, further comprising a flange extending from said web portion upper marginal edge for engaging said guide rail.

7. The pull-out guide as claimed in claim 6, further comprising a pull-out rail roller rotatably mounted on said web portion for engaging said guide rail.

8. The pull-out guide as claimed in claim 7, said support members each having a generally triangular shape.

* * * * *